US009573238B2

(12) United States Patent
Fujita

(10) Patent No.: US 9,573,238 B2
(45) Date of Patent: Feb. 21, 2017

(54) DIAMETER EXPANSION DRILL BIT

(71) Applicant: FS TECHNICAL CORPORATION, Tokyo (JP)

(72) Inventor: Shogo Fujita, Tokyo (JP)

(73) Assignee: FS TECHNICAL CORPORATION, Tokyo (JP)

( * ) Notice: Subject to any disclaimer, the term of this patent is extended or adjusted under 35 U.S.C. 154(b) by 114 days.

(21) Appl. No.: 14/406,775

(22) PCT Filed: Jan. 29, 2014

(86) PCT No.: PCT/JP2014/000450

§ 371 (c)(1),
(2) Date: Dec. 10, 2014

(87) PCT Pub. No.: WO2014/129119

PCT Pub. Date: Aug. 28, 2014

(65) Prior Publication Data

US 2015/0165583 A1 Jun. 18, 2015

(30) Foreign Application Priority Data

Feb. 19, 2013 (JP) ..... 2013-029882
May 16, 2013 (JP) ..... 2013-103992

(51) Int. Cl.
*B24B 5/48* (2006.01)
*B24B 5/40* (2006.01)
(Continued)

(52) U.S. Cl.
CPC . *B24B 5/48* (2013.01); *B24B 5/40* (2013.01); *B24B 33/02* (2013.01); *B28D 1/146* (2013.01); *E21B 10/32* (2013.01)

(58) Field of Classification Search
CPC ..... B24B 5/40; B24B 5/48; B24B 33/02; B24B 33/105; B28D 1/146; E21B 10/32
See application file for complete search history.

(56) References Cited

U.S. PATENT DOCUMENTS 5,233,791 A * 8/1993 McQueen, Jr. ..... B21B 45/04 451/481
9,138,868 B2 * 9/2015 McDowell ..... B24B 5/40
(Continued)

FOREIGN PATENT DOCUMENTS

EP 1 267 033 A1 12/2002
JP 54-130301 U 9/1979
(Continued)

OTHER PUBLICATIONS

Jan. 8, 2016 Extended Search Report issued in European Patent Application No. 14753517.3.
Apr. 8, 2014 Written Opinion issued in PCT/JP2014/000450.

*Primary Examiner* — Timothy V Eley
(74) *Attorney, Agent, or Firm* — Oliff PLC

(57) ABSTRACT

A diameter expansion drill bit used for inserting in a prepared hole perforated in a framework to expand a diameter of a portion of the prepared hole by grinding has a plurality of blade sections that grind the portion of the prepared hole, a blade holding section that holds the plurality of blade sections movably in a radial direction respectively, and a shank section that supports the blade holding section, and the plurality of blade sections move to spread outwardly in the radial direction with respect to the blade holding section by centrifugal force due to rotation.

14 Claims, 14 Drawing Sheets

(51) Int. Cl.

| | |
|---|---|
| ***B28D 1/14*** | (2006.01) |
| ***E21B 10/32*** | (2006.01) |
| ***B24B 33/02*** | (2006.01) |

(56) References Cited

U.S. PATENT DOCUMENTS

| | | | |
|---|---|---|---|
| 2002/0119419 | A1 | 8/2002 | Suzuki et al. |
| 2002/0189865 | A1 | 12/2002 | Kleine et al. |
| 2011/0053469 | A1 | 3/2011 | McDowell et al. |

FOREIGN PATENT DOCUMENTS

| | | | |
|---|---|---|---|
| JP | 61-134490 | A | 6/1986 |
| JP | 6-55530 | A | 3/1994 |
| JP | 2000-336647 | A | 12/2000 |
| JP | 2003-056270 | A | 2/2003 |
| JP | 2003-079639 | A | 3/2003 |
| JP | 2005-023773 | A | 1/2005 |
| JP | 2005-280243 | A | 10/2005 |
| JP | 2010-201733 | A | 9/2010 |
| WO | 2011/137494 | A1 | 11/2011 |

* cited by examiner

DIAMETER EXPANSION DRILL BIT

TECHNICAL FIELD

The present invention relates mainly to a diameter expansion drill bit which expands a portion of a prepared hole perforated in a framework such as concrete.

BACKGROUND ART

An undercut drill apparatus has been known as this kind of diameter expansion drill bit which is used to be inserted into a straight-shaped prepared hole perforated in a framework such as concrete and expands an innermost of the prepared hole (see Patent Document 1).

The undercut drill apparatus has a hollow cylindrically-shaped cylindrical body inserted into the prepared hole, an abutting member which abuts on an opening edge portion of the prepared hole and rotatably supports the cylindrical body via a bearing, a shaft which slidably engages with the cylindrical body coaxially and rotates with the cylindrical body integrally, a frustum-shaped corn section which is provided at a tip side of the cylindrical body and has four guide grooves on an outer circumferential surface, four arms which are attached on a tip portion of the shaft and engages with each guide groove, and two blades and two guide sections which are provided on an outer surface of a tip portion of the four arms alternately.

The blades and the guide sections locate inside the cylindrical body with a state that the shaft is pulled up when the cylindrical body inserted in the prepared hole and the shaft are rotated integrally and the shaft is moved downwardly, the four arms move downwardly and open outwardly along the guide grooves of the corn section. Thus, the blades grind an inner circumferential surface of the prepared hole to form a diameter expansion portion at a bottom (the innermost) of the prepared hole.

[Patent Document 1] JP-A-2005-280243

DISCLOSURE OF THE INVENTION

Problems That the Invention is to Solve

Since this kind of undercut drill apparatus has a structure in which the arms having blades are guided on the outer circumferential surface of the corn section, the corn section has to be supported by the cylindrical body, leading to a more complex structure. Further, since the arms, the corn section and the cylindrical body are arranged outside the shaft, a diameter of the apparatus becomes large and the apparatus cannot be used for prepared hole having a comparatively smaller diameter.

An advantage of the invention is to provide a diameter expansion drill bit which has a simple structure and can adapt to a prepared hole having a small diameter.

Means for Solving the Problem

According to one aspect of the invention, there is provided a diameter expansion drill bit used for inserting in a prepared hole perforated in a framework to expand a diameter of a portion of the prepared hole by grinding comprising: a plurality of blade sections that grind the portion of the prepared hole; a blade holding section that holds the plurality of blade sections movably in a radial direction respectively; and a shank section that supports the blade holding section, wherein the plurality of blade sections move to spread outwardly in the radial direction with respect to the blade holding section by centrifugal force due to rotation.

According to the structure, when the shank section is rotated in a state being inserted, the plurality of blade sections of the bit section receive the centrifugal force to move outwardly in the radial direction. In other words, the plurality of blade sections rotating with the blade holding section move in such a way as to spread outwardly in the radial direction by the centrifugal force and to grind to expand a diameter of the portion in the prepared hole. In this case, since the plurality of blade sections are moved by the centrifugal force, a structure thereof can be simplified. Further, the plurality of blade sections inserted into the prepared hole can be disposed with the blade holding section in the radial direction integrally, and an outer cylinder in a related art is not necessary.

Therefore, a prepared hole having a small diameter can be adapted (expanded).

In this case, it is preferable that each blade section include a weight.

According to the structure, since strong centrifugal force can act on each blade section, it is possible to promote to grind the prepared hole and to expand the diameter in a short time.

Further, it is preferable that the blade holding section have a steeple portion that positions to project at a tip portion coaxially.

According to the structure, the diameter of an innermost can be expanded by contacting and rotating the steeple portion on a bottom of the prepared hole for grinding. Further, on rotation, friction with the bottom can be as smallest as possible and rotation shift of the bit section can be restrained.

Further, it is preferable that the blade holding section have a large diameter fitting portion that is fit into the prepared hole and is formed having a larger diameter than a diameter of the plurality of blade sections in a non-expansion state and a diameter of the shank section.

According to the structure, since a diameter of the large diameter fitting portion rotating as portion of the blade holding section is formed as same size as a diameter of the prepared hole in which the large diameter fitting portion is inserted, the large diameter fitting portion can function as member that avoids the rotation shift. Therefore, rotation of the blade holding section and the blade sections on grinding can be stable and the diameter expansion of the prepared hole by the plurality of blade sections can be performed smoothly in a short time.

While, it is preferable that the blade holding section have a plurality of blade opening portions that hold the plurality of blade sections movably, and wherein each blade section have a blade body that has an outer circumferential portion in an arc shape in cross section, a rib portion that supports the blade body and slidably engages with the blade opening portion in a radial direction, and a retaining portion that is provided on a base side of the rib portion and functions as retention against the blade holding section.

According to the structure, the blade sections moving outwardly in the radial direction by the centrifugal force move slidinglly such that the rib portion thereof is guided by the blade opening portions of the blade holding section. In this case, since each rib portion engages with the blade opening portion slidably in the radial direction, the blade body moves laterally and outwardly in the radial direction. Thus, it is possible to grind (the portion of) the prepared hole evenly. Further, since the retaining portion regulates a movement end position of the blade body moving outwardly in the radial direction, the blade section can be prevented from dropping off from the blade holding section and a diameter expansion size of the prepared hole can be constant.

Likewise, it is preferable that the blade holding section have a plurality of blade opening portions that hold the plurality of blade sections movably, and each blade section have a blade body that has an outer circumferential portion in an arc shape in cross section and slidably engaging with the blade opening portion in a radial direction, and a retaining portion that is provided on a base side of the blade body and functions as retention against the blade holding section.

Also, in this case, since the blade body moves laterally and outwardly in the radial direction, it is possible to grind (the portion of) the prepared hole evenly. Further, the blade sections can be prevented from dropping off from the blade holding section by the retaining portion and a diameter expansion size of the prepared hole can be constant.

Likewise, it is preferable that each blade section have an outer circumferential portion in an arc form in cross section and a slide hole extending to the radial direction, and the blade holding section have a plurality of slidingly contacting and holding portions that slidably hold the plurality of blade sections in the radial direction via each slide hole According to the structure, the blade sections moving outwardly in the radial direction by the centrifugal force is guided to slidingly move by the slidingly contacting and holding portions. Thus, since the blade sections move laterally and outwardly, (the portion of) the prepared hole can be ground evenly. Further, since the slidingly contacting and holding portions regulate the movement end position of the blade sections moving outwardly in the radial direction, the blade sections can be prevented from dropping off from the blade holding section and the diameter expansion size of the prepared hole can be constant.

Likewise, it is preferable that each blade section have a blade body that has an outer circumferential portion in an arc shape in cross section and a sliding portion of "C"-shaped in cross section that supports the blade body, and the blade holding section have a retaining and holding portion that holds the plurality of blade sections in the radial direction slidably and in a retaining state via each sliding portion.

Also, in this case, since the blade sections move laterally and outwardly in the radial direction, (the portion of) the prepared hole can be ground evenly. Further, the blade sections can be prevented from dropping off from the blade holding section by the retaining and holding portion and the diameter expansion size of the prepared hole can be constant.

Meanwhile, it is preferable that the outer circumferential portion of the arc-shaped in cross section be formed having larger curvature than curvature of an arc to a rotation center of the blade holding section.

According to the structure, each blade section grinds the prepared hole at an arc-shaped intermediate portion of the outer circumferential surface. Therefore, a scratching is not generated at initial rotation and frictional resistance (grinding resistance) of the blade sections can be smaller than that of grinding with a whole outer circumferential surface. Therefore, grinding can be proceeded smoothly.

Further, it is preferable that each blade section be formed in a circular ring shape in cross section and the blade holding section have a plurality of holding pins that hold the plurality of blade sections in a loosely fitting state.

According to the structure, when the centrifugal force by rotation acts on the blade sections, the blade sections are swung outwardly in the radial direction in the loosely fitting gap between the holding pins. Therefore, the blade sections contact on the prepared hole and rotate appropriately, while moving outwardly in the radial direction. Thus, it is possible to grind (the portion of) the prepared hole evenly and to make decrease of the blade sections evenly flat (to perform automatic dressing). Further, since the holding pins regulate the movement end position of the blade sections moving outwardly in the radial direction, the blade sections can be prevented from dropping off from the blade holding section and the diameter expansion size of the prepared hole can be constant.

Further, it is preferable that the plurality of blade sections be made up of two blade sections that are disposed at point-symmetric positions at 180 degrees.

According to the structure, it is possible to make the blade sections and round thereof in a simple structure without deteriorating grinding performance.

While, it is preferable that the diameter expansion drill bit further have a shaft section that is detachably mounted on a rotation shaft of a power source side at a base side and supports the shank section coaxially at a tip side.

According to the structure, introduction and the like of a coolant from a power source side can be performed properly.

In this case, it is preferable that the shaft section have a joint convex section on which the shank section is detachably joined, the shank section have a joint concave section in which the joint convex section is joined, a first buffer member be provided between the joint convex section and the joint concave section in the radial direction, and a second buffer member be further provided between the joint convex section and the joint concave section in the axial direction.

According to the structure, vibration caused by the grinding can be absorbed in the radial direction and the axial direction suitably. Therefore, it is possible to grind the prepared hole properly and durability of the blade sections, the blade holding section and the like can be improved.

Further, it is preferable that the shaft section have an in-shaft channel in a shaft center and the shank section have an in-shank channel in a shaft center communicating with the in-shaft channel to supply a coolant to the plurality of blade sections.

According to the structure, the coolant can be supplied from the power source side to the plurality of blade sections via the in-shaft channel and the in-shank channel. Therefore, the diameter expansion of the prepared hole can be performed smoothly and efficiently. Further, the plurality of blade sections can receive spreading force by the coolant discharged from the tip of the in-shank channel. Cooling liquid, compressed air, cooling gas or the like is preferably used.

Still further, it is preferable that the diameter expansion drill bit further have an adjustment attachment that is attached on either one of the shaft section and the shank section and can adjust insertion depth of the bit section into the prepared hole by contacting on an opening edge portion of the prepared hole.

According to the structure, the adjustment attachment can adjust the insertion depth of the plurality of blade sections into the prepared hole and can expand a diameter in the prepared hole at an arbitrary insertion depth.

DESCRIPTION OF EXEMPLARY EMBODIMENTS

Hereinafter, a diameter expansion drill bit according to one embodiment of the invention will be explained referring to accompanying drawings. The diameter expansion drill bit mainly expands a diameter of a portion of a prepared hole formed in a framework such as concrete or stone to strike an anchor and is configured to enhance pull-out strength of the struck anchor. The straight-shaped prepared hole perforated by a diamond core drill or the like is perforated broader at an opening portion side than at an inner side due to slight axial runout and is substantially formed in a slightly tapered shape. Therefore, in case that the struck anchor repetitively receives a great deal of power such as earthquake, the pull-out strength decreases sequentially. The diameter expansion drill bit expands the portion of the prepared hole by a same operation procedure as the prepared hole to avoid the sequential decrease in the pull-out strength of such an anchor.

Figure 1:
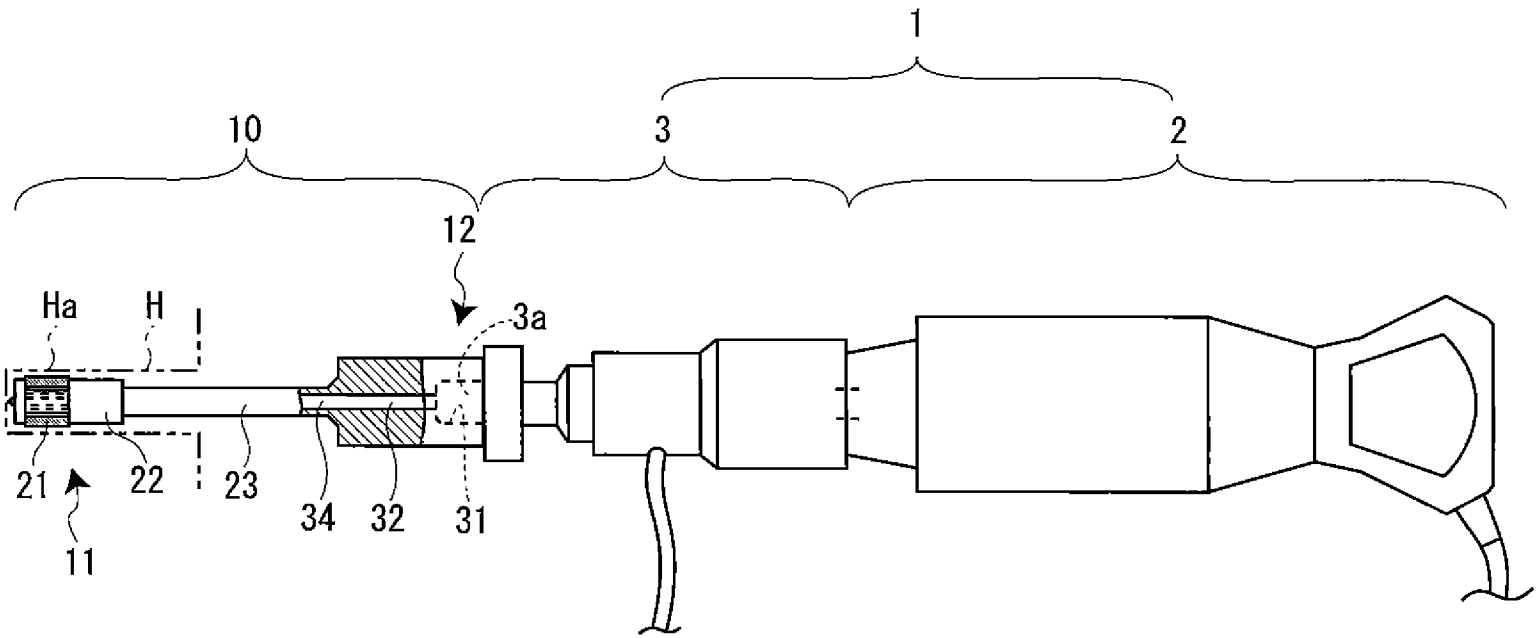
FIG. 1 is an appearance view of a diameter expansion drill bit according to an embodiment mounted on a perforating apparatus.

FIG. 1 is an appearance view of the diameter expansion drill bit mounted on a perforating apparatus. As illustrated in FIG. 1, a perforating apparatus 1 includes a handheld electric drill 2 and a cooling liquid attachment 3 mounted on the electric drill 2, and a diameter expansion drill bit 10 is mounted on the cooling liquid attachment 3. In other words, the diameter expansion drill bit 10 is used to be detachably mounted on a rotation shaft 3*a* in the cooling liquid attachment 3 of the perforating apparatus 1 (electric drill 2) constituting a power source.

A channel for the cooling liquid is formed in the rotation shaft 3*a* and the cooling liquid attachment 3 is connected with a cooling liquid supply apparatus (not illustrated). The cooling liquid is supplied from the cooling liquid supply apparatus to a tip portion of the diameter expansion drill bit 10 via the cooling liquid attachment 3. With the perforating apparatus 1 of the embodiment, after a prepared hole H is perforated by a perforating drill bit (for example, a diamond core bit) mounted on the cooling liquid attachment 3, the perforating drill bit is replaced by the diameter expansion drill bit 10 to expand a diameter at an innermost Ha of the prepared hole H.

Figure 2:
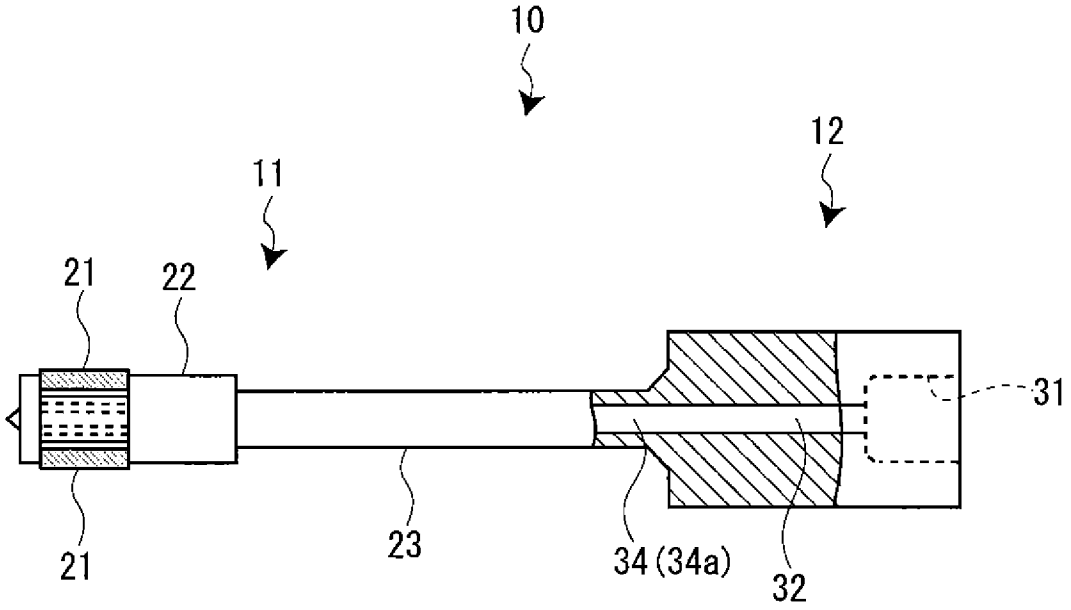
FIG. 2 is a structural view of the diameter expansion drill bit according to the first embodiment.
Figure 3:
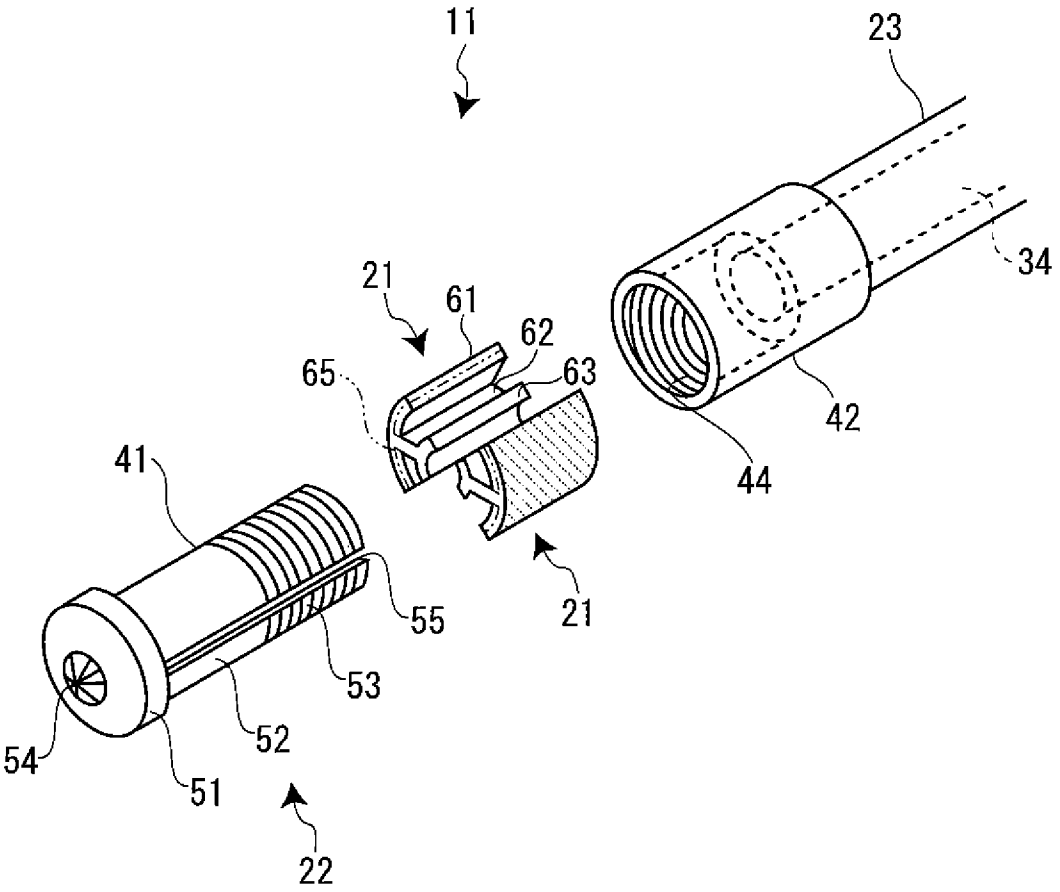
FIG. 3 is a perspective view around a bit section of the diameter expansion drill bit.
Figure 4A:
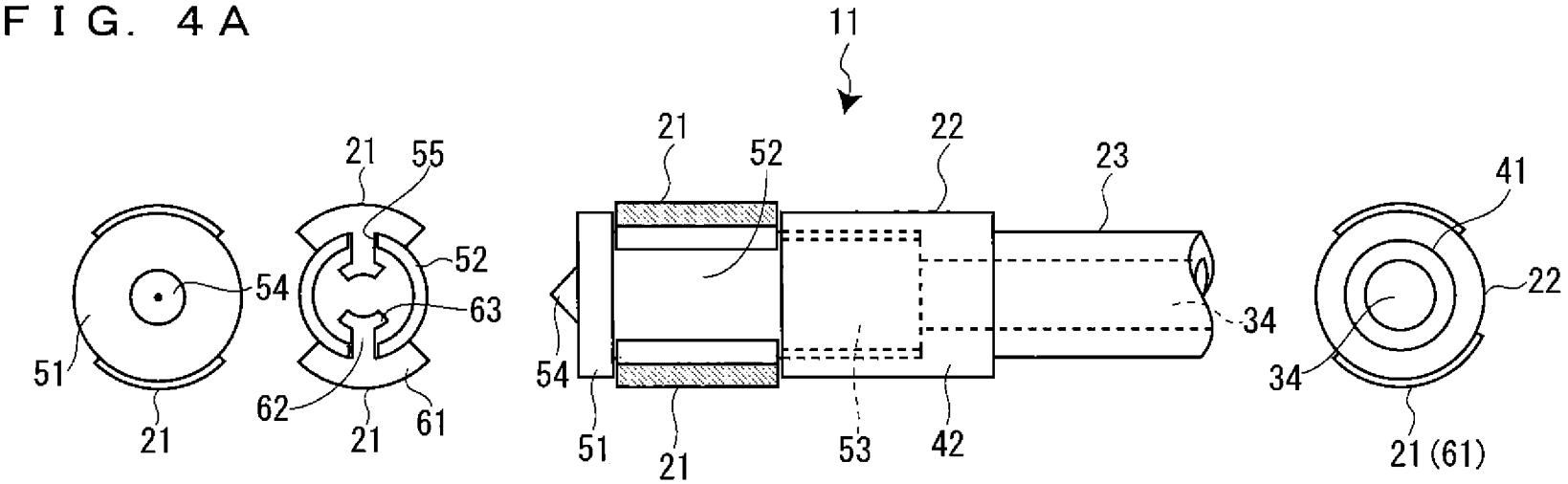
FIG. 4A is a structural view around the bit section of the diameter expansion drill bit and FIG. 4B is an exploded structural view thereof.
Figure 4B:
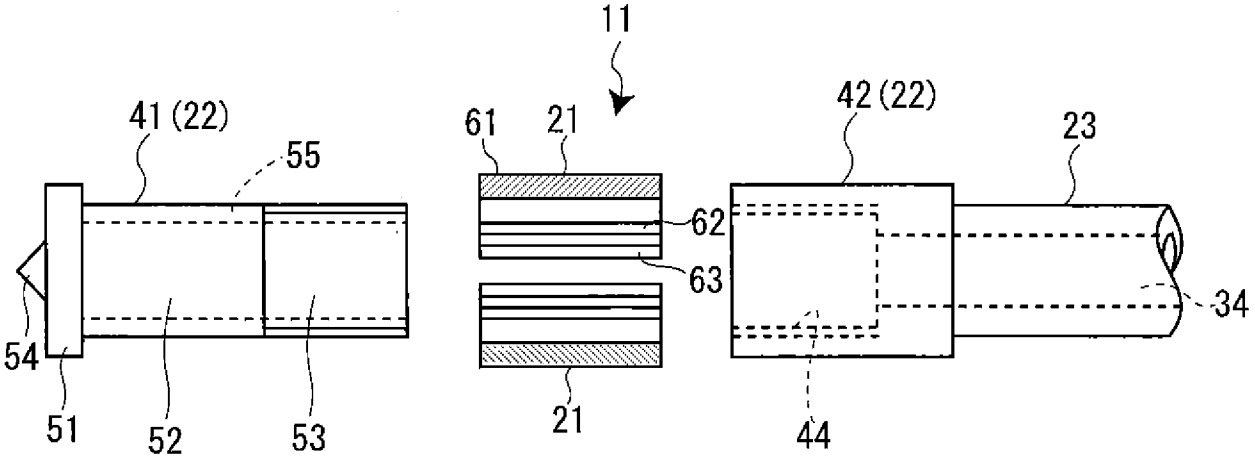

FIG. 2 is a structural view of the diameter drill bit 10 according to the first embodiment. As illustrated in FIG. 2, the diameter expansion drill bit 10 has a bit section 11 which expands the diameter of the prepared hole H at a tip portion thereof and a shaft section 12 detachably mounted on the rotation shaft 3*a* (cooling liquid attachment 3) of the perforating apparatus 1 at a base side and supporting a base portion of the bit section 11 at a tip side thereof coaxially.

Further, the bit section 11 has a plurality of (two in the embodiment) blade sections 21 which grind the prepared hole H, a blade holding section 22 which holds the plurality of blade sections 21 movably in a radial direction, and a shank section 23 which supports the plurality of blade sections 21 via the blade holding section 22. The plurality of blade sections 21 of the diameter expansion drill bit 10 expand outwardly in the radial direction due to centrifugal force by rotating the diameter expansion drill bit 10 by the perforating apparatus 1 in a state that the bit section 11 is being inserted in the prepared hole H (see FIGS. 5A and 5B).

The shaft section 12 has a female screw portion 31 formed in a hollow shape at a cross section thereof, and the female screw portion 31 is screwed by a male screw portion (see FIG. 1) in the rotation shaft 3*a* of the cooling liquid attachment 3. Although not illustrated, a tool engagement portion for a wrench is formed on the shaft section 12, and the shaft section 12 is detachably mounted on the cooling liquid attachment 3, that is, the perforating apparatus 1 by the female screw portion 31.

An in-shaft channel 32 for the cooling liquid is formed in a shaft center of the shaft section 12. The in-shaft channel 32 communicates with the cooling liquid attachment 3 at a base side and communicates with an in-bit channel 34 (described later) at a tip side. When the shaft section 12 is mounted on the rotation shaft 3*a* of the cooling liquid attachment 3, the in-shaft channel 32, the in-bit channel 34 and the cooling liquid attachment 3 communicate to one another, and the cooling liquid can flow from the cooling liquid attachment 3.

As illustrated in FIGS. 2 to 4B, the bit section 11 has the shank section 23 extending from a tip of the shaft section 12, the cylindrical blade holding section 22 provided on a tip of the shank section 23 and the two blade sections 21 held on the blade holding section 22. In this case, an outer diameter of the two blade sections 21 is formed slightly smaller than an inner diameter of the prepared hole H. Further, an outer diameter of the blade holding section 22 is formed slightly smaller than the outer diameter of the two blade sections 21, and an outer diameter of the shank section 23 is formed smaller than the outer diameter of the blade holding section 22.

While, the in-bit channel 34 communicating with the above in-shaft channel 32 is formed at the shaft center of the shank portion 23 and inside the blade holding portion 22. The cooling liquid introduced in the in-bit channel 34 is discharged into the prepared hole H from two slit portions 55 (blade opening portion) (described later) of the blade holding section 22 toward the two blade sections 21. An in-shank channel 34*a* of the in-bit channel 34 is made up by a portion formed in the shank portion 23. Further, compressed air or cooling gas can be used instead of the cooling liquid (described later in detail).

The blade holding section 22 has a holding section body 41 which holds the two blade sections 21 along an outer circumferential surface thereof and a holding section receptor 42 into which the holding section body 41 is attached. A base side of the holding section receptor 42 is attached to the shank section 23, and a female screw 44 is formed in an inner circumferential surface at a tip side which is screwed by the holding section body 41. In the embodiment, the holding section receptor 42, the shank section 23 and the shaft section 12 are formed integrally. The holding section receptor 42, the shank section 23 and the shaft section 12 may be separate members properly and may be joined by a screw or bonded by welding. Further, the holding section receptor 42 is formed having a large diameter by the shank section 23 and the in-bit channel 34 is formed including a portion of the female screw 44 inside these sections.

The holding section body 41 has a tip flange portion 51 in a flange shape, a cylindrical holding portion 52 which continues to the tip flange portion 51 and holds the two blade sections 21, and a cylindrical screw portion 53 which continues to the cylindrical holding portion 52. Further, the holding section body 41 has a steeple portion 54 which is provided on a central tip of the tip flange portion 51, and a plurality of (two) slit portions 55 (blade opening portions) formed in the cylindrical holding portion 52 and the cylindrical screw portion 53. In this case, the tip flange portion 51, the cylindrical holding portion 52, the cylindrical screw portion 53 and the steeple portion 54 are preferably formed integrally. Inner sides of the cylindrical holding portion 52 and the cylindrical screw portion 53 function as a portion of the in-bit channel 34.

The tip flange portion 51 and the holding section receptor 42 are formed to have a same diameter and are disposed to sandwich the blade sections 21 held on the cylindrical holding section 52 with a slight gap in an axial direction. Though details will be explained later, each blade section 21 is held on the cylindrical holding section 52 via the slit portions 55, and the cylindrical screw portion 53 is screwed in the female screw 44 of the holding section receptor 42 in this state. It is preferable that a tool engagement portion be provided on the tip flange portion 51 to screw the holding section body 41 in the holding section receptor 42 (not illustrated).

Though the cylindrical screw portion 53 is formed with the male screw on an outer circumferential surface thereof, it is formed to have a same diameter with the cylindrical holding portion 52. Further, the two slit portions 55 are formed in such a way as to cut into the cylindrical holding portion 52 from a base of the cylindrical screw portion 53. Still further, the two slit portions 55 are formed at point-symmetric positions at 180 degrees in a circumferential direction of the cylindrical holding portion 52 and the cylindrical screw portion 53. Therefore, each blade section 21 is mounted on the cylindrical holding section 52 slidingly from the base end, that is, from the cross section of the cylindrical screw portion 53. Further, the holding section body 41 is attached in the holding section receptor 42 after the two blade sections 21 are mounted.

Each blade section 21 has a blade body 61 provided along an outer circumferential surface of the blade holding portion 52, a rib portion 62 projected inside the blade body 61, and a retaining portion 63 provided on a tip of the rib portion 62. The blade body 61 and the rib portion 63 have a cross section of approximately ¼ arc, and the rib portion 62 is slidably engaged with the slit portions 55 in the radial direction. In other words, the blade body 61 positions outside the blade holding portion 52 (holding section body 41) and the retaining section 62 positions inside the blade holding portion 52. In this state, the rib portion 62 slidably engages with the slit portion 55.

Therefore, the two blade sections 21 held on the blade holding section 22 spread outwardly in the radial direction due to the centrifugal force by rotation. Shortly, an inner surface of the blade body 61 contacts on the outer circumferential surface of the above cylindrical holding portion 52 in an initial spreading state, and an outer surface of the retaining portion 63 contacts on an inner circumferential surface of the cylindrical holding portion 52 (see FIGS. 5A and 5B). The blade body 61 of the embodiment has substantial thickness in consideration of decrease caused by grinding, and the grinding of the diameter expansion portion is, indeed, preferably managed by time (around ten to twenty seconds). Therefore, in case that the retaining portion 63 is in a state of contacting on the cylindrical holding portion 52, the blade section 21 needs to be exchanged (due to an operating life). Since the diameter expansion of the prepared hole H in the embodiment is for enhancing the pull-out strength of the anchor, a diameter expansion size may be minute. Thus, a sliding movement of the blade section 21 is preferably around one to two mm.

Further, though the rib portion 62 and the retaining portion 63 are formed to have the same size in the axial direction with respect to the blade body 61, the portion 62 and the retaining portion 63 may be formed in a shorter size. The rib portion 62 and the retaining portion 63 may be formed in a larger size in the axial direction or the circumferential direction to promote the spreading of the blade section 21 by the cooling liquid (described later in detail).

The blade body 61 is made up of a diamond blade in an arc shape in cross section and diamonds for grinding are provided on an outer circumferential portion thereof. Thus, an inner circumferential surface of the innermost Ha of the prepared hole H is ground to expand to a predetermined size. Further, it is preferable that the blade section 21 gets strong centrifugal force on grinding. Therefore, a weight 65 is preferably provided on an inner surface of the blade body 61 (illustrated by an imaginary line in FIG. 3). The weight 65 is formed by material having heavy specific gravity such as zinc or tungsten.

Figure 5A:
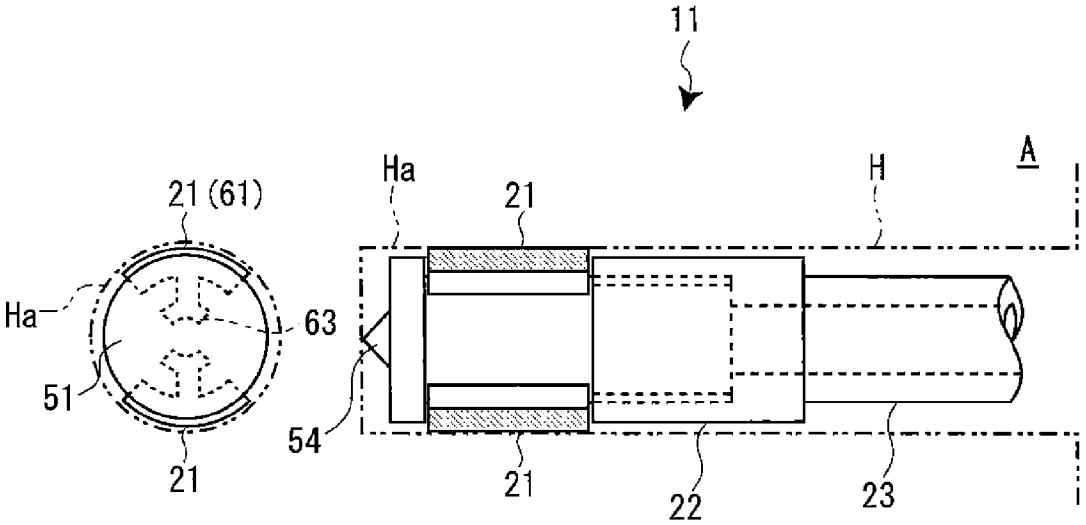
FIGS. 5A and 5B are explanatory views for diameter expansion action of the diameter expansion drill bit.
Figure 5B:
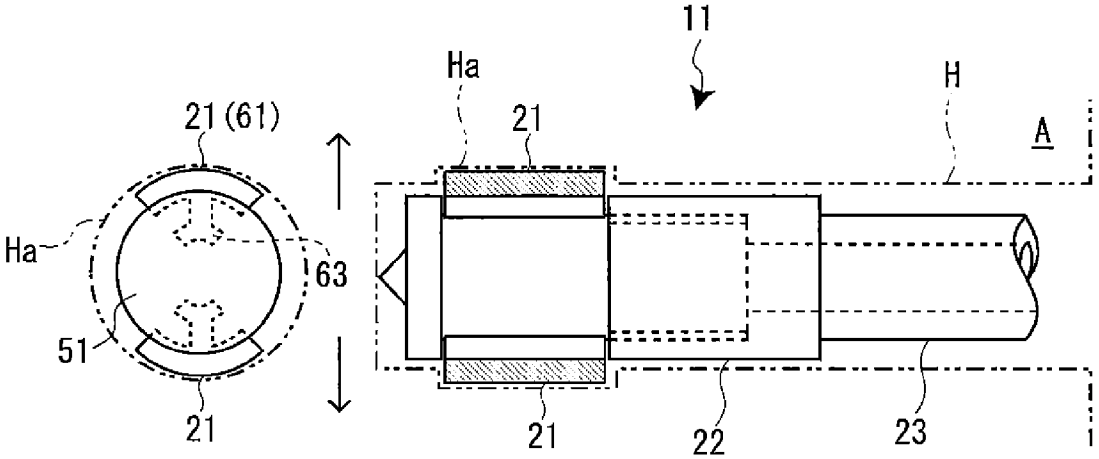

Since the blade body 61 is formed in the arc shape, a grinding portion thereof moves from a whole arc-shaped circumferential surface to an intermediate portion as the spreading progresses (see FIGS. 5A and 5B). Shortly, since frictional resistance of the blade body 61 becomes smaller as the grinding progresses, the grinding can be performed smoothly. The arc-shaped outer circumferential portion of the blade body 61 may be formed by an arc having larger curvature than that of an arc to a rotation center of the blade holding section 22. Further, it is also preferable that a tip side in the circumferential direction (tip side in a rotation direction) of the blade body 61 be chamfered to make the grinding resistance smaller in the initial grinding. In the circumferential direction, the diameter of this portion when the two blade sections 21 are in the initial state is formed shorter than that of the prepared hole H about 0.5 to 1.0 mm, which enables the bit section 11 to be inserted in the prepared hole H smoothly.

Referring to FIGS. 1 to 5, a diameter expansion operation to the prepared hole H by the diameter expansion drill bit 10 will be explained. In the diameter expansion operation, the prepared hole H has been preliminarily formed in a concrete framework A or the like as object. The concrete framework A in this case includes an underwork, a beam and the like, in addition to an exterior wall, an interior wall, a slab made of concrete. The prepared hole H is formed with a perforation operation using the above mentioned perforating apparatus 1 having the diamond core bit thereon.

In the diameter expansion operation, the diameter expansion drill bit 10 is mounted on the perforating apparatus 1 to insert the bit section 11 into the prepared hole H (see FIG. 5A). After the steeple portion 54 of the bit section 11 is inserted to abut on a bottom of the prepared hole H, the diameter expansion drill bit 10 is rotated by driving the electric drill 2. Simultaneously or in tandem, the cooling liquid is supplied to the blade sections 21 via the in-shaft channel 32 and the in-bit channel 34.

When the diameter expansion drill bit 10 rotates, the centrifugal force acts on the two blade sections 21 and spreads the two blade sections 21 outwardly (see FIG. 5B). Further, the cooling liquid discharged from a tip portion of the in-bit channel 34 also spreads radially at an inside portion of the two blade sections 21 by the centrifugal force, leading to promote the spreading of the blade sections 21. Thus, each blade body 61 of the rotating bit section 11 grinds the inner surface of the prepared hole H and the innermost Ha of the prepared hole H is expanded. Then, the retaining section 63 is positionally regulated by the holding section body 41 or after a predetermined time passes, the innermost Ha is expanded to a predetermined size.

Then, an operator turns off the electric drill 2 to stop the rotation of the diameter expansion drill bit 10 (the supply of the cooling liquid also stops). Thus, the centrifugal force acting on the two blade sections 21 returns to zero and the two blade sections 21 close to return to the initial state. Subsequently, the bit section 11 is pulled out.

Thus, in the first embodiment, it is possible to expand the diameter of the innermost Ha of the prepared hole H simply and in a short time only by inserting and rotating the bit section 11 in the prepared hole H. Further, since the plurality of blade sections 21 are configured to spread by the centrifugal force, the structure of the apparatus can be simplified. Still further, since the two blade sections 21 can be disposed with the blade holding section 22 integrally in the radial direction, appropriate diameter expansion can be performed in the prepared hole H having a small diameter.

Figure 6B:
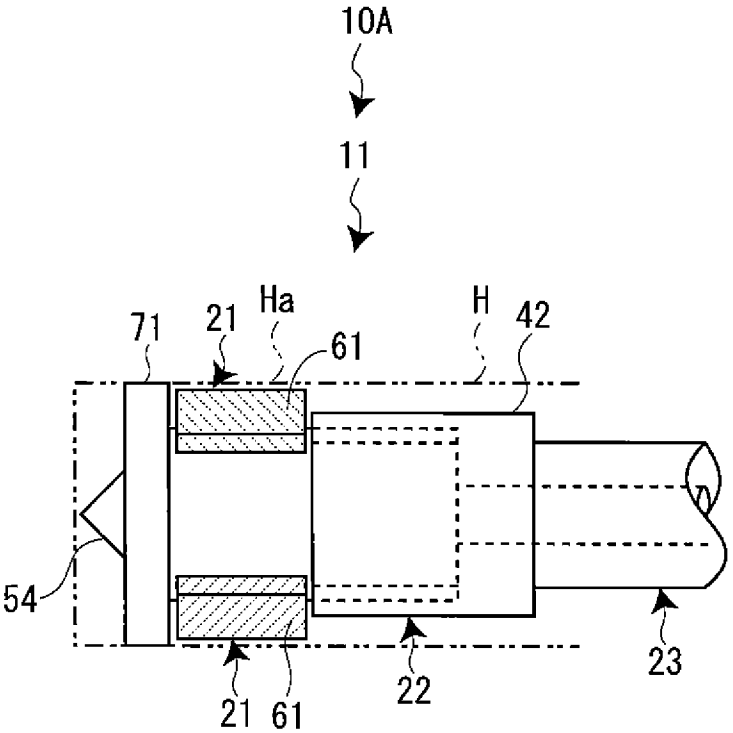
FIG. 6A is a sectional view around the bit section of the diameter expansion drill bit according to the second embodiment and FIG. 6B is a structural view thereof.
Figure 6A:
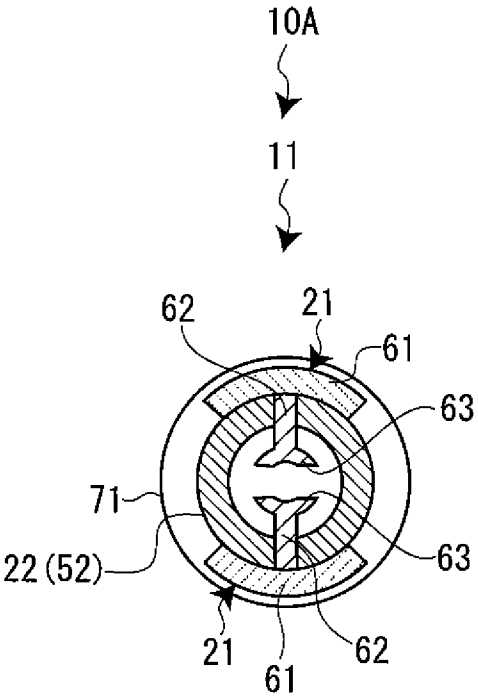

Next, a diameter expansion drill bit 10A of the second embodiment will be explained with reference to FIGS. 6A and 6B, especially focusing on portions different from those of the first embodiment. As illustrated in FIGS. 6A and 6B, in the diameter expansion drill bit 10A, a portion corresponding to the tip flange portion 51 of the first embodiment is a large diameter fitting portion 71 which has the largest diameter in the bit section 11. In other words, the large diameter fitting portion 71 is formed slightly larger than the two blade sections 21 in a non-spreading state and the shank section 23 and is formed slightly smaller (to an extent to fit) than (the innermost Ha of) the prepared hole H.

When the bit section 11 is inserted into the prepared hole H, the steeple portion 54 abuts on the bottom of the prepared hole H and the large diameter fitting portion 71 positions at the innermost Ha of the prepared hole H. When the bit section 11 rotates in that state, the large diameter fitting portion 71 rotates in a state being inserted in the prepared hole H around the steeple section 54 as rotation center. In this case, the prepared hole H functions as bearing with the cooling liquid as lubricant with respect to the large diameter fitting portion 71, which prevents rotational shift of the bit section 11. Thus, the grinding by the two blade sections 21 in the prepared hole H (diameter expansion portion) can be performed smoothly.

Further, the outer circumferential portion (outer circumferential surface) of the blade body 61 of each blade section 21 is formed having a larger curvature arc than that of an arc to the rotation center of the blade holding section 22. Thus, since the frictional resistance on grinding becomes small, the grinding can be performed smoothly. Moreover, the retaining portion 63 of each blade section 21 is cut at a surface perpendicular to the rib section 62 so as to have a large pressure reception area for the cooling liquid.

Figure 7B:
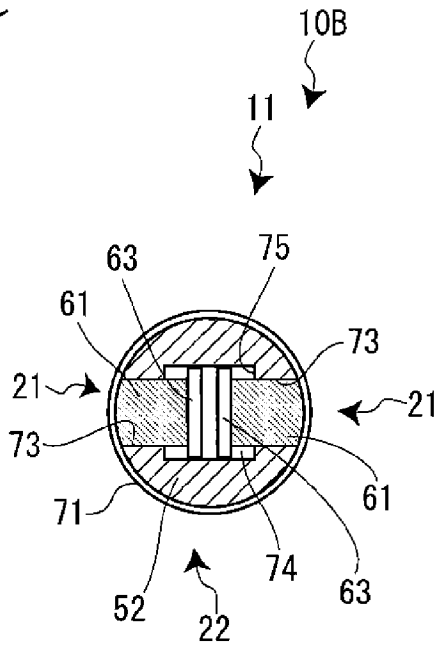
FIG. 7A is an exploded perspective view around the bit section of the diameter expansion drill bit according to the third embodiment and FIG. 7B is a sectional view thereof.
Figure 7A:
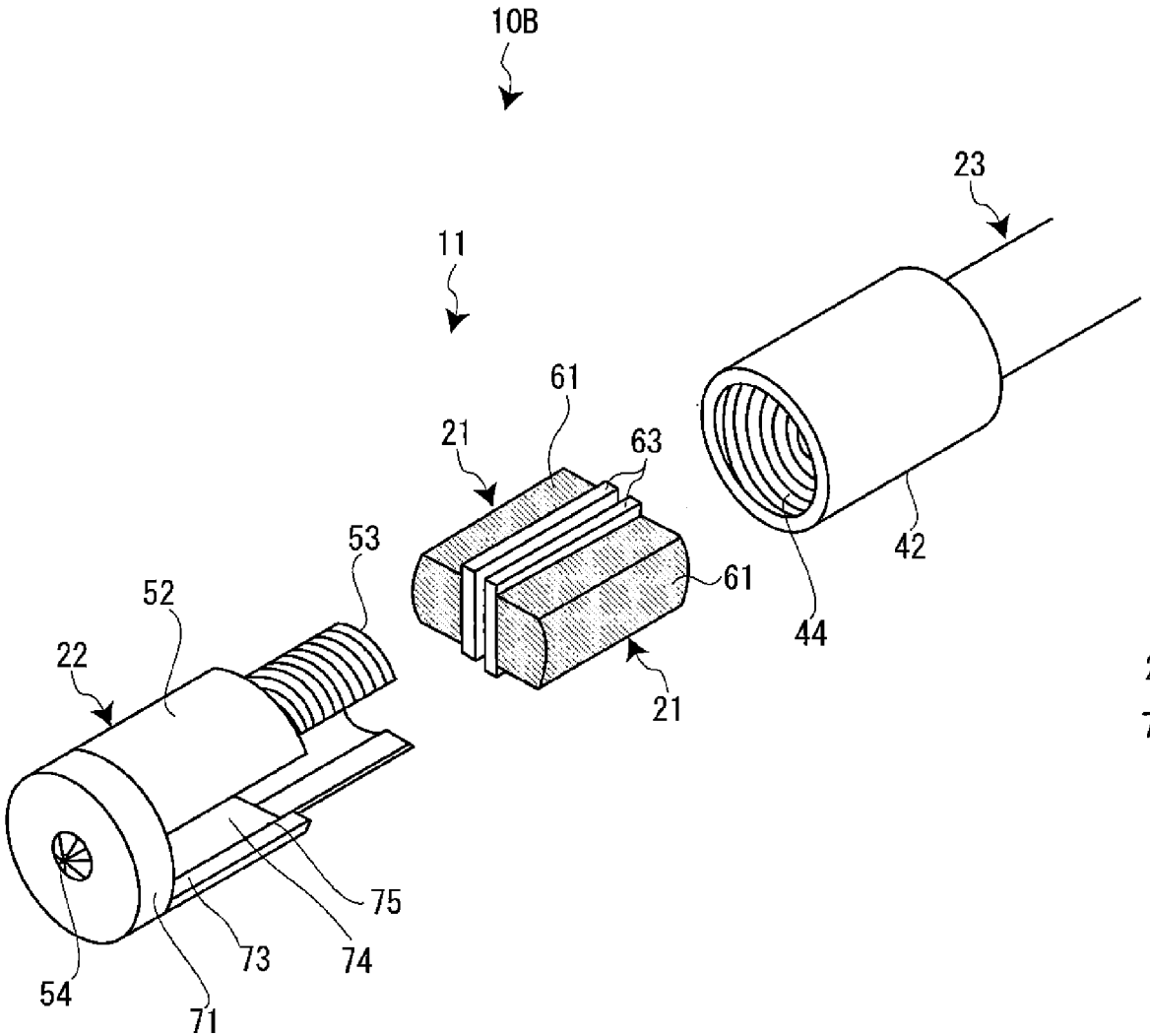

Next, a diameter expansion drill bit 10B of the third embodiment will be explained with reference to FIGS. 7A and 7B, especially focusing on portions different from those of the above embodiments. As illustrated in FIGS. 7A and 7B, in the diameter expansion drill bit 10B, each blade section 21 is made up of the blade body 61 and the retaining portion 63, while broad blade opening portions 73 corresponding to the slit portions 55 of the first embodiment are formed in the cylindrical holding portion 52 and the cylindrical screw portion 53 correspondingly.

The cylindrical holding portion 52 is formed to have an approximately same diameter as the shank section 23. The two blade opening portions 73 are formed at point-symmetric positions at 180 degrees in the circumferential direction of the cylindrical holding portion 52. A rectangular cross sectional guide chamber 74 continuing to the two blade opening portions 73 is formed in an inner surface of the cylindrical holding portion 52, and the retaining portions 63 of both the blade portions 21 are faced to each other in the guide chamber 74. The blade body 61 is guided by the blade opening portion 73 and the retaining portion 63 is guided by the guide chamber 74 respectively to slidingly move (spread) outwardly in the radial direction. Further, since the retaining portion 63 abuts on a stepped portion 75 between the guide chamber 74 and the blade opening section 73, an outward movable end position in the radial direction of the blade section 21 is regulated.

Each blade section 21 has the blade body 61 of which outer circumferential surface (arc surface) is provided to be flush with the outer circumferential surface of the cylindrical holding portion 52, and planar retaining portion 63 provided at a base of the blade body 61. The retaining portion 63 is formed broader than the blade body 61 to function as retention with the stepped portion 75 between the guide chamber 74 and the blade opening portion 73. The blade body 61 slidably engages with the blade opening portion 73 and the retaining portion 63 slidably engages with an inner wall surface of the guide chamber 74 in the radial direction.

In such a structure, the diameter of the inner most Ha of the prepared hole H can be expanded simply and in a short time only by inserting and rotating the bit section 11 in the prepared hole H. Further, since the two blade portions 21 are spread by the centrifugal force, the apparatus structure can be simplified.

Figure 8B:
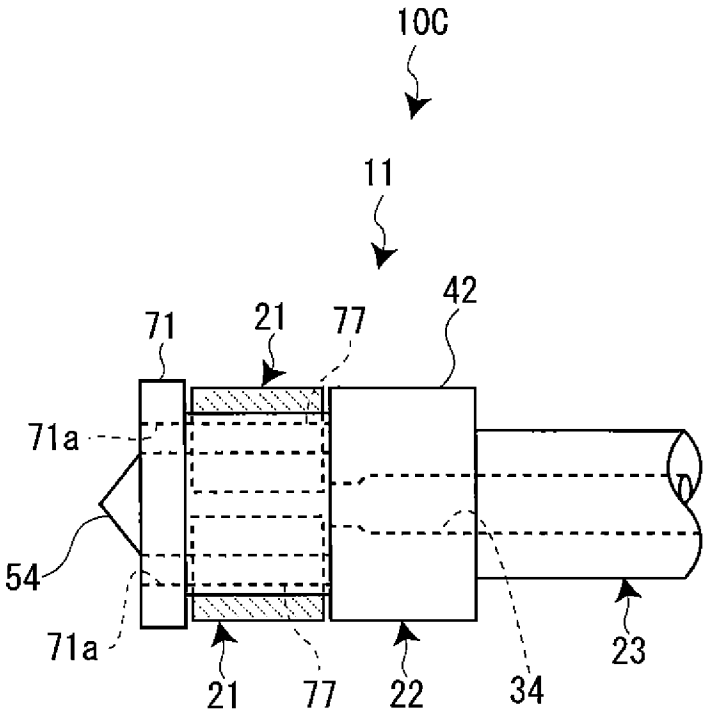
FIG. 8A is a sectional view around the bit section of the diameter expansion drill bit according to the fourth embodiment and FIG. 8B is a structural view thereof.
Figure 8A:
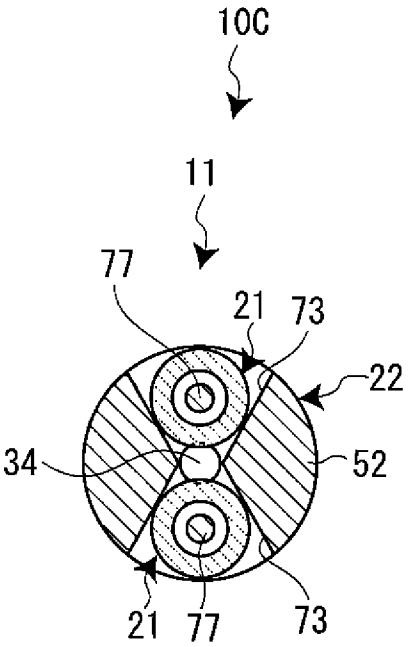

Next, a diameter expansion drill bit 10C of the fourth embodiment will be explained with reference to FIGS. 8A and 8B, especially focusing on portions different from those of the above embodiments. As illustrated in FIGS. 8A and 8B, in the diameter expansion drill bit 10C, each blade section 21 is formed in a circular ring shape in cross section. Further, the blade holding section 22 has two holding pins 77 which hold each blade section 21 in a loosely fitting state. Still further, the blade opening portions 73 of the blade holding section 22 are formed broader toward an outside in the radial direction to allow the blade portions 21 to move in the radial direction.

Each holding pin 77 is formed in a shape of a round bar and extends from an end surface of the holding section receptor 42 in the axial direction. The blade section 21 is held by the holding pin 77 having a sufficient gap inside the blade section 21, and a gap size is regarded as moving distance in the radial direction. When the centrifugal force by rotation acts on each blade section 21, the blade section 21 shifts outwardly in the radial direction within the loosely fitting gap between the holding pin 77. Thus, the blade section 21 contacts on the prepared hole H to grind therein. Further, the blade section 21 receives resistance on grinding and rotates by itself. Thus, decrease of the blade section 21 caused by grinding can be equalized.

While, in the diameter expansion drill bit 10C, the cylindrical screw portion 53 is not provided and the cylindrical holding portion 52 is integrally formed with the holding section receptor 42. Further, the large diameter fitting portion 71 is bonded to the two holding pins 77 extending from the holding section receptor 42. In other words, the large diameter fitting portion 71 has two bonded holes 71*a* in which a tip portion of each holding pin 77 is fit. The tip portions of the holding pins 77 are fit in the bonded holes 71*a* and are bonded (brazed or welded) therein. More specifically, each blade section 21 is mounted on the holding pin 77, and the large diameter fitting section 71 is bonded in the tip portion of the holding pin 77 in this state. Thus, the blade section 21 is held by the blade holding section 22 such that the blade section 21 is sandwiched between the holding section receptor 42 and the large diameter fitting portion 71 having a slight gap in the axial direction.

Further, a diameter of the in-bit channel 34 is shortened at a tip side of the holding section receptor 42 and is open to a central portion of the end face. The cooling liquid is vigorously discharged between the two blade sections 21 because of the diameter-shortened portion to promote spreading of the two blade sections 21. The blade holding section 22 may be joined by a screw with the shank section 23 at the holding section receptor 42. This allows the operator to integrally exchange the blade holding section 22 and the blade sections 21 as unit when the blade sections 21 decreases.

Figure 9B:
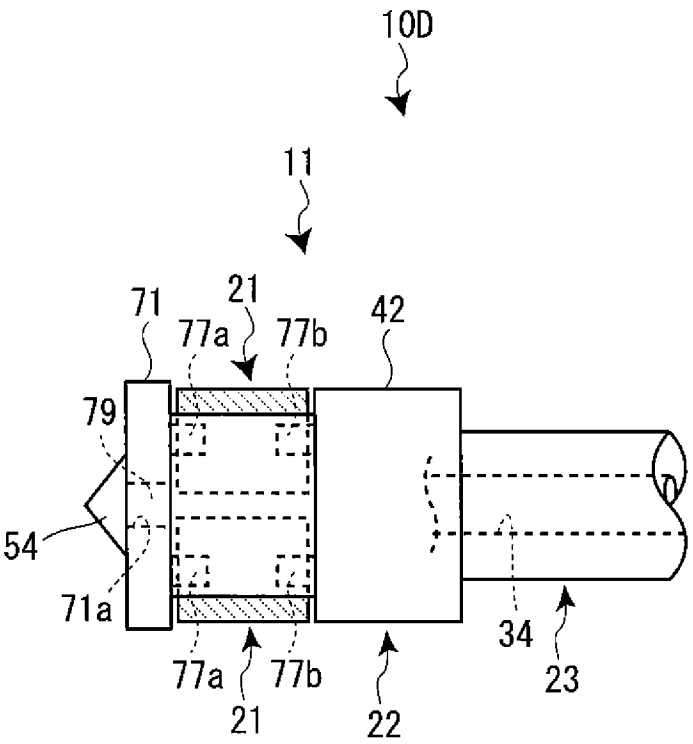
FIG. 9A is a sectional view around the bit section of the diameter expansion drill bit according to the fifth embodiment and FIG. 9B is a structural view thereof.
Figure 9A:
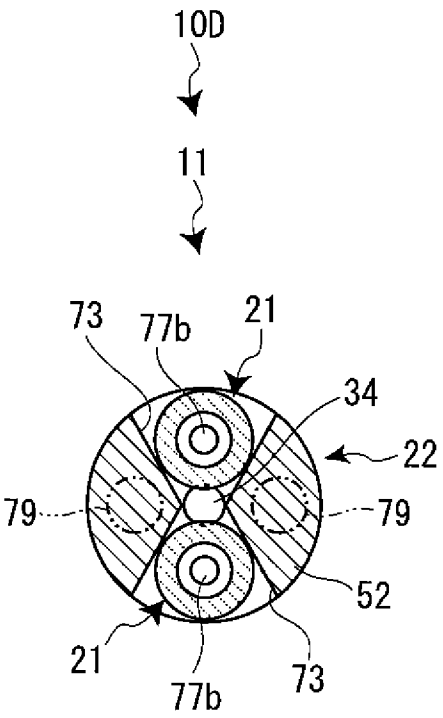

Next, a diameter expansion drill bit 10D of the fifth embodiment will be explained with reference to FIGS. 9A and 9B, especially focusing on portions different from those of the above embodiments. As illustrated in FIGS. 9A and 9B, in the diameter expansion drill bit 10D, the large diameter fitting portion 71 is bonded to the two bonding pins 79 extending from the cylindrical holding portion 52, which is different from the diameter expansion drill bit 10C according to the fourth embodiment. Shortly, the two bonding pins 79 are projected at point-symmetric positions at 180 degrees on an end surface of the cylindrical holding portion 52, and the large diameter fitting portion 71 is mounted on the cylindrical holding portion 52 by fitting the bonding pins 79 into the corresponding two bonded holes 71*a* and bonding (brazing or welding) them.

Further, the holding pins 77 of the diameter expansion drill bit 10D are different from those of the fourth embodiment, and are made up of two tip side holding pins 77*a* extending from the large diameter fitting portion 71 and two base side holding pins 77*b* extending from the cylindrical holding portion 52. The tip side holding pin 77*a* and the base side holding pins 77*b* position coaxially and hold the blade section 21 of a circular ring shape in cross section in the loosely fitting state as the above fourth embodiment.

Figure 10:
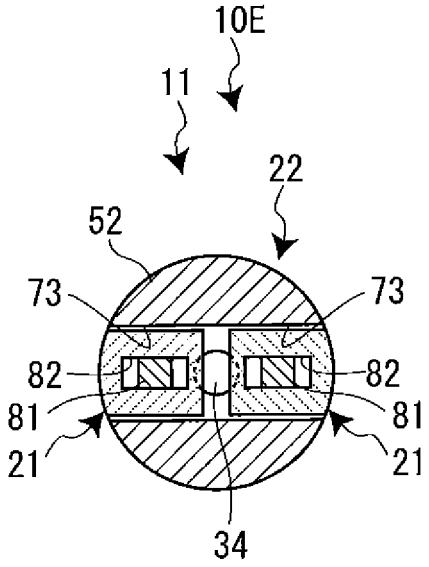
FIG. 10 is a sectional view around the bit section of the diameter expansion drill bit according to the sixth embodiment.

Next, a diameter expansion drill bit 10E of the sixth embodiment will be explained with reference to FIG. 10, especially focusing on portions different from those of the above embodiments. As illustrated in FIG. 10, in the diameter expansion drill bit 10E, two slidingly contact pins 81 (slidingly contacting and holding portions) formed rectangular in cross section are provided in place of holding pins 77 in the fourth and the fifth embodiments. While, each blade section 21 has an outer circumferential portion in an arc shape in cross section and is formed lengthwise in the radial direction. Further, each blade section 21 has a slide hole 82 extending to the radial direction and is held by the slidingly contact pin 81 at the slide hole 82.

Shortly, the blade section 21 is slidably held in the radial direction via the slide hole 82 on the slidingly contact pin 81. Further, the outer circumferential surface (arc surface) of the blade section 21 is disposed to flush with the outer circumferential surface of the cylindrical holding portion 52. When the centrifugal force acts on the blade section 21 by rotation, the blade sections 21 slide outwardly in the radial direction, and the outer circumferential portions thereof project from the cylindrical holding section 52. Thus, the rotating two blade sections 21 contact on the prepared hole H simultaneously for grinding. Further, also in this case, the cooling liquid vigorously discharged between the two blade sections 21 promotes the spreading of the two blade sections 21.

Figure 11:
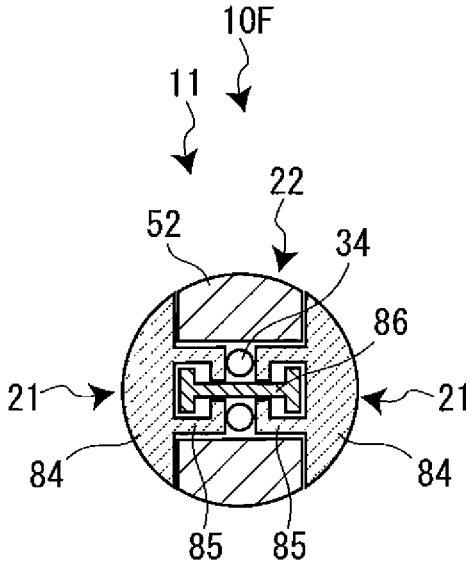
FIG. 11 is a sectional view around the bit section of the diameter expansion drill bit according to the seventh embodiment.

Next, a diameter expansion drill bit 10F of the seventh embodiment will be explained with reference to FIG. 11, especially focusing on portions different from those of the above embodiments. As illustrated in FIG. 11, in the diameter expansion drill bit 10F, each blade section 21 has a blade body 84 having an arc-shaped outer circumferential portion in cross section and a "C"-shaped sliding portion 85 in cross section which supports the blade body 84. Further, the blade holding section 22 has a retaining and holding portion 86 which holds the two blade sections 21 slidably in the radial direction and in a retaining state via each sliding portion 85.

The retaining and holding portion 86 is formed as "H"-shape in cross section in consideration of retention and is formed integrally with the holding section receptor 42 as the cylindrical holding portion 52. The centrifugal force by rotation acts on the blade sections 21, the blade sections 21 slidingly move outwardly in the radial direction and contact on the prepared hole H for grinding. Further, a channel end of the in-bit channel 34 is open at two points where the retaining and holding portion 86 is located therebetween. Also in this case, the cooling liquid is discharged vigorously between the two blade sections 21 and promotes the spreading of the two blading sections.

Figure 12:
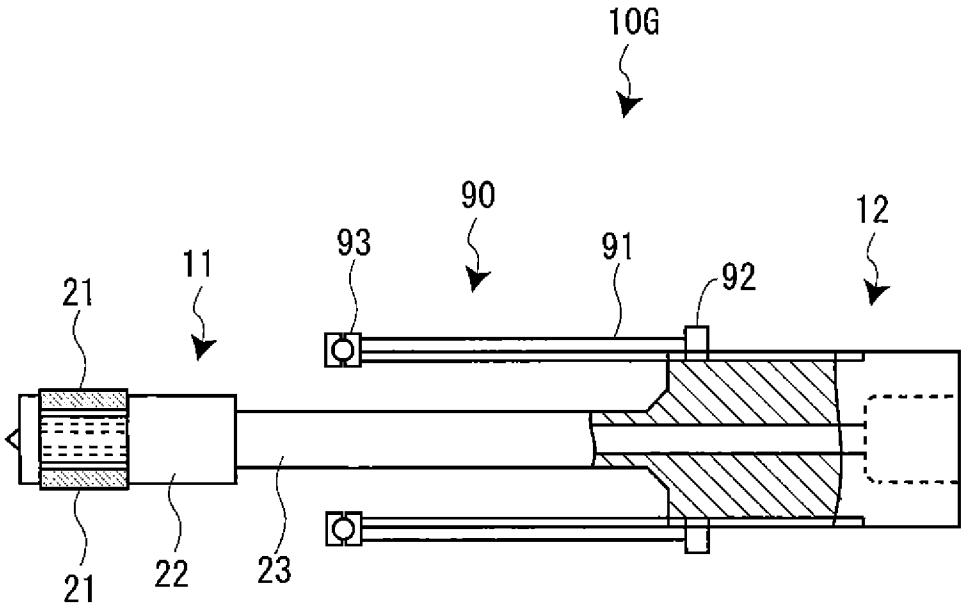
FIG. 12 is a structural view of the diameter expansion drill bit according to the eighth embodiment.

Next, a diameter expansion drill bit 10G of the eighth embodiment will be explained with reference to FIG. 12, especially focusing on portions different from the first embodiment. As illustrated in FIG. 12, the diameter expansion drill bit 10G intends to expand a diameter of an arbitrary position in the prepared hole H, which is different from the diameter expansion drill bit 10 expanding the diameter at the innermost Ha in the prepared hole H. Therefore, the diameter expansion drill bit 10G of the eighth embodiment further has an adjustment attachment 90 which can adjust insertion depth of the bit section 11 into the prepared hole H.

The adjustment attachment 90 has a cylindrical attachment body 91 screwed on the shaft section 12, a stopper screw portion 92 which is adjacent to the attachment body 91 and is screwed on the shaft section 12, and a circular ring-shaped rotation reception portion 93 provided at a tip portion of the attachment body 91.

A male screw is formed on the outer circumferential surface of the shaft section 12, and female screws are formed on the inner circumferential surfaces of the attachment body 91 and the stopper screw portion 92 correspondingly. After the stopper screw portion 92 is deeply screwed on the shaft section 12, the attachment body 91 is screwed to adjust the insertion depth of the bit section 11 into the prepared hole H. After the completion of the adjustment, the stopper screw portion 92 is returned back to prevent the attachment body 91 from winding down and is fastened to contact to the attachment body 91. A scale for indexing the insertion depth is preferably formed on the outer circumferential surface of the shaft section 12.

The rotation reception portion 93 is made up of, for example, a thrust bearing and is configured to abut on an opening edge portion of the prepared hole H. Though the attachment body 91 and the stopper screw portion 92 rotate with the shaft section 12, the rotation reception section 93 disengages the rotation not to transmit rotation power to the opening edge portion of the prepared hole H.

In such a structure, the insertion depth of the bit section 11 into the prepared hole H can be adjusted by threaded depth of the attachment body 91. Shortly, a diameter expanded portion can be formed at an arbitrary depth position in the prepared hole H. In this embodiment, the adjustment attachment 90 is provided on the shaft section 12, but may be provided on the shank section 23. In this case, the adjustment attachment 90 can be small.

Figure 13:
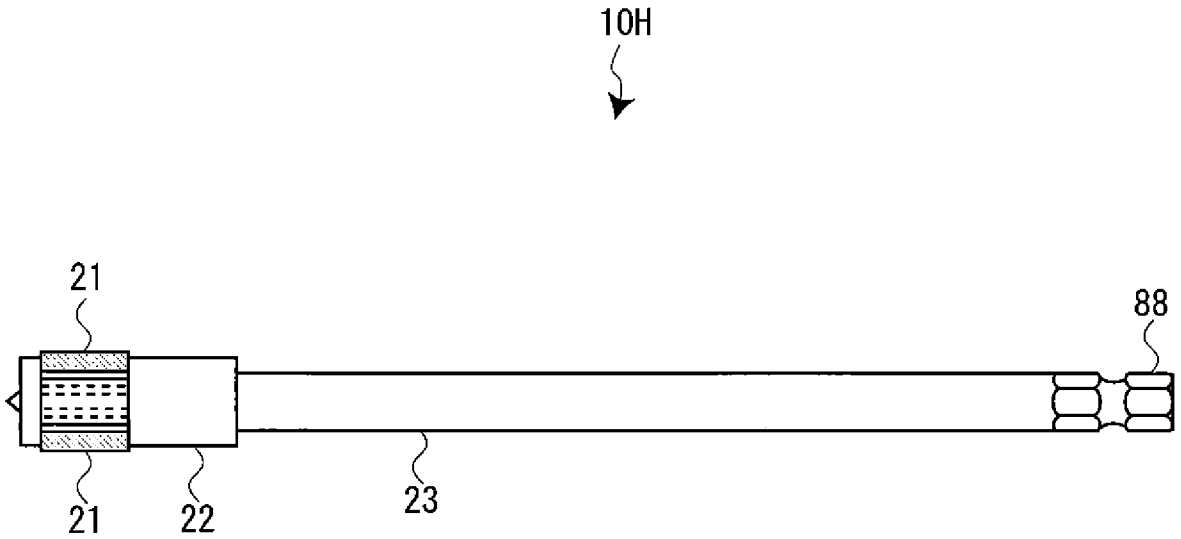
FIG. 13 is a structural view of the diameter expansion drill bit according to the ninth embodiment.

Next, a diameter expansion drill bit 10H of the ninth embodiment will be explained with reference to FIG. 13, especially focusing on portions different from those of the above embodiments. As illustrated in FIG. 13, the diameter expansion drill bit 10H differs from the above embodiments in that the diameter expansion drill bit 10H does not have the shaft section 12 and is used to chuck on the electric drill directly. The two blade sections 21 and the blade holding section 22 are unitized as the fourth embodiment to the seventh embodiment and are attached on the tip of the shank section 23 by a screw. While, the shank section 23 has a hexagonal chucked portion 88 at a base portion thereof.

With such a structure, the simplified diameter expansion drill bit 10H which grinds the prepared hole H can be provided without supplying the cooling liquid.

Figure 14A:
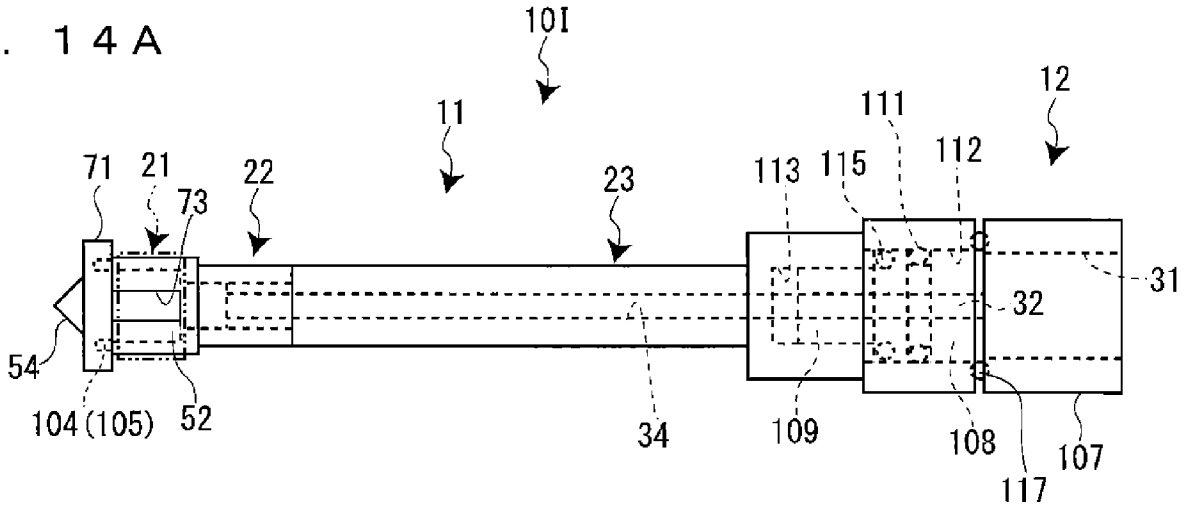
FIG. 14A is a structural view of the diameter expansion drill bit according to the tenth embodiment and FIG. 14B is an exploded structural view thereof.
Figure 14B:
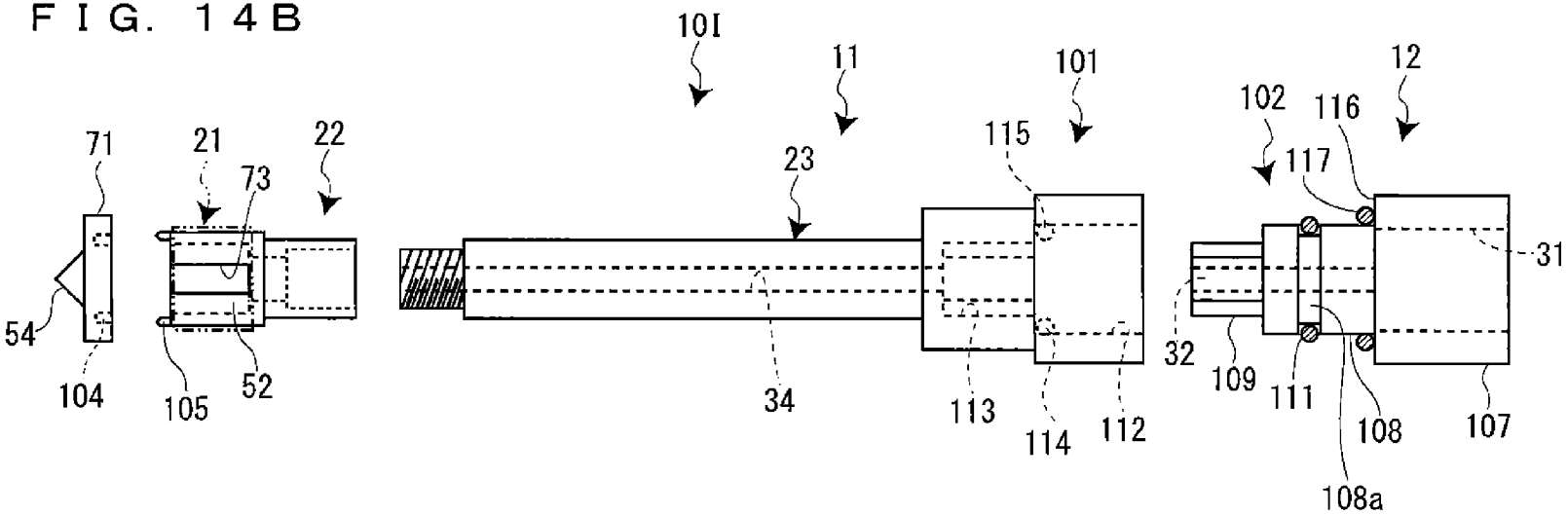

Next, a diameter expansion drill bit 10I of the tenth embodiment will be explained with reference to FIGS. 14A and 14B, especially focusing on portions different from those of the above embodiments. As illustrated in FIGS. 14A and 14B, in the diameter expansion drill bit 10I, the two blade sections 21 and the blade holding section 22 are unitized and are attached to the tip of the shank section 23 by a screw. Further, a joint concave section 101 is formed at the base portion of the shank section 23 and a joint convex section 102 is formed at the tip portion of the shaft section 12 correspondingly. A joint portion of the joint concave section 101 and the joint convex section 102 absorbs vibration caused by grinding on the bit section 11 (blade sections 21).

An annular groove 104 is formed on an end surface of the large diameter fitting portion 71 and an annular boss 105 corresponding to the annular groove 104 is formed on an end surface of the cylindrical holding portion 52. The two blade sections 21 and the blade holding section 22 are unitized by mounting the blade sections 21 on a blade opening portion 73 of the cylindrical holding portion 52 and fitting to bond (solder or weld) the annular boss 105 in the annular groove 104.

The shaft section 12 has a body shaft portion 107 which is attached to the electric drill 2 side, a fitting shaft portion 108 which extends forward from the body shaft portion 107 and a power shaft portion 109 which extends forward from the fitting shaft portion 108. The fitting shaft portion 108 and the power shaft portion 109 form the joint convex section 102. The fitting shaft portion 108 is formed in a cylindrical shape and a ring groove 108*a* for attaching a first O-ring 111 (first buffer member) is formed on an outer circumferential surface thereof. The power shaft portion 109 is formed in a hexagonal tubular shape and transmits the rotation force input from the electric drill 2 to the shank section 23.

The joint concave section 101 has a first concave portion 112 in which the fitting shaft portion 108 fits and a second concave portion 113 in which the power shaft portion 109 fits. The first O-ring 111 is provided between the first concave portion 112 and the fitting shaft portion 108 to seal the cooling liquid and to absorb radial vibration. The second concave portion 113 has a complementary shape with the power shaft portion 109 and is joined such that the rotation of the power shaft portion 109 can be transmitted to the second concave portion 113 and the second concave portion 113 can be slidable with respect to the power shaft portion 109. The power shaft portion 109 and the second concave section 113 may be in a joint shape such as spline or serration.

Further, a second O-ring 115 (second buffer member) is provided at an annular stepped portion 114 between the first concave section 112 and the second concave section 113. When the joint convex section 102 is joined on the joint concave section 101, the second O-ring 115 is squeezed between the annular stepped portion 114 and the fitting shaft portion 108. Thus, the cooling liquid is sealed and axial vibration is absorbed. Similarly, a third O-ring 117 (third buffer member) is provided on an annular stepped portion 116 between the body shaft portion 107 and the fitting shaft portion 108. When the joint convex section 102 is joined on the joint concave section 101, the third O-ring 117 is squeezed between the annular stepped portion 116 (end surface of the body shaft portion 107) and an end surface of the joint concave section 101. Thus, the cooling liquid is sealed and the axial vibration is absorbed.

Though the two blade sections 21 are disposed in point symmetry, rotation causes vibration. In the above embodiment, since the radial vibration is absorbed by the first O-ring 111 and the axial vibration is absorbed by the second O-ring 115 and the third O-ring 117 respectively, the operator does not feel a sense of strangeness, durability of the bit section 11 is not affected, and the prepared hole H can be ground properly. Either the second O-ring 115 or the third O-ring 117 may be omitted.

In the embodiments, the number of blade sections 21 is two, but three or more blade sections may be provided. A nozzle for the cooling liquid may be provided at the tip of the shank section 23, and the cooling liquid may be flown from an inner side to the retaining portion 63 of the blade sections 21 so as to promote the spreading of the blade sections 21. While, in case that the compressed air or cooling gas is used instead of the cooling liquid, a compressed air supply apparatus (such as a compressor) may be used to connect to the cooling liquid attachment 3 in exchange for the cooling liquid supply apparatus, or a cooling gas attachment may be used in exchange for the cooling liquid attachment 3, on which a gas cylinder such as liquid gas can be mounted. Further, blade body 61 in the embodiments, the blade made of diamond is used, but the blade made of carbon tool steel, alloy tool steel, high speed tool steel, cemented carbide, ceramic, cermet, cubic boron nitride or the like may be used.

[Reference Numerals]

1: perforating apparatus 2: electric drill 3: cooling liquid attachment 3*a:* rotation shaft 10, 10A: diameter expansion drill bit 11, 11A: bit section 12: shaft section 21: blade section 22: blade holding section 23: shank section 32: in-shaft channel 34: in-bit channel 34*a:* in-shank channel 41: holding section body 42: holding section receptor 51: tip flange portion 52: cylindrical holding portion 53: cylindrical screw portion 54: steeple portion 55: slit portion 61, 84: blade body 62: rib portion 63: retaining portion 65: weight 71: large diameter fitting portion 73: blade opening portion 77: holding pin 81: sliding pin 82: slide hole 85: sliding portion 86: retaining and holding portion 90: adjustment attachment 101: joint concave section 102: joint convex section 111: first O-ring 115: second O-ring 117: third O-ring A: concrete framework H: prepared hole Ha: innermost

What is claimed is:

1. A diameter expansion drill bit used for inserting in an anchoring prepared hole perforated in a framework to expand a diameter of a portion of the prepared hole by grinding comprising:

a plurality of blade sections being capable of grinding the portion of the prepared hole;

a blade holding section that holds the plurality of blade sections so as to be slidingly movable in a radial direction respectively; and a shank section that supports the blade holding section, wherein the blade holding section has a steeple portion that positions to project at a tip portion of the blade holding section coaxially, and wherein the plurality of blade sections are capable of slidingly spreading outwardly in the radial direction with respect to the blade holding section by centrifugal force due to rotation.

2. The diameter expansion drill bit according to claim 1, wherein each blade section includes a weight.

3. The diameter expansion drill bit according to claim 1, wherein the blade holding section has a large diameter fitting portion that is fit into the prepared hole and is formed having a larger diameter than a diameter of each of the plurality of blade sections in a non-expansion state and having a larger diameter than a diameter of the shank section.

4. The diameter expansion drill bit according to claim 1, wherein the blade holding section has a plurality of blade opening portions that hold the plurality of blade sections movably, and wherein each blade section has a blade body that has an outer circumferential portion in an arc shape in cross section, a rib portion that supports the blade body and slidably engages with the blade opening portion in a radial direction, and a retaining portion that is provided on a base side of the rib portion and functions as retention against the blade holding section.

5. The diameter expansion drill bit according to claim 4, wherein the outer circumferential portion of the arc-shaped in cross section is formed having larger curvature than curvature of an arc to a rotation center of the blade holding section.

6. The diameter expansion drill bit according to claim 1, wherein the blade holding section has a plurality of blade opening portions that hold the plurality of blade sections movably, and each blade section has a blade body that has an outer circumferential portion in an arc shape in cross section and slidably engaging with the blade opening portion in a radial direction, and a retaining portion that is provided on a base side of the blade body and functions as retention against the blade holding section.

7. The diameter expansion drill bit according to claim 1, wherein each blade section has an outer circumferential portion in an arc form in cross section and a slide hole extending in the radial direction of the blade holding section, and the blade holding section has a plurality of slidingly contacting and holding portions that slidably hold the plurality of blade sections in the radial direction via each slide hole.

8. The diameter expansion drill bit according to claim 1, wherein each blade section has a blade body that has an outer circumferential portion in an arc shape in cross section and a sliding portion of "C"-shaped in cross section that supports the blade body, and the blade holding section has a retaining and holding portion that holds the plurality of blade sections in the radial direction slidably and in a retaining state via each sliding portion.

9. The diameter expansion drill bit according to claim 1, wherein each blade section is formed in a circular ring shape in cross section and the blade holding section has a plurality of holding pins that hold the plurality of blade sections in a loosely fitting state.

10. The diameter expansion drill bit according to claim 1, wherein the plurality of blade sections are made up of two blade sections that are disposed at point-symmetric positions at 180 degrees.

11. The diameter expansion drill bit according to claim 1 further having a shaft section that is detachably mounted on a rotation shaft of a power source side at a base side of the shaft section and supports the shank section coaxially at a tip side of the shaft section.

12. The diameter expansion drill bit according to claim 11, wherein the shaft section has a joint convex section on which the shank section is detachably joined, the shank section has a joint concave section in which the joint convex section is joined, a first buffer member is provided between the joint convex section and the joint concave section in the radial direction, and a second buffer member is further provided between the joint convex section and the joint concave section in an axial direction.

13. The diameter expansion drill bit according to claim 11, wherein the shaft section has an in-shaft channel in a shaft center and the shank section has an in-shank channel in a shaft center communicating with the in-shaft channel to supply a coolant to the plurality of blade sections.

14. The diameter expansion drill bit according to claim 11 further having an adjustment attachment that is attached on either one of the shaft section and the shank section and can adjust insertion depth of a bit section into the prepared hole by contacting on an opening edge portion of the prepared hole.

* * * * *